US005420556A

United States Patent [19]

Okazaki

[11] Patent Number: 5,420,556

[45] Date of Patent: May 30, 1995

[54] MULTIPOLAR WIGGLER

[75] Inventor: Toru Okazaki, Osaka, Japan

[73] Assignee: Sumitomo Electric Industries, Ltd., Osaka, Japan

[21] Appl. No.: 991,566

[22] Filed: Dec. 15, 1992

[51] Int. Cl.[6] ..... H01F 1/00

[52] U.S. Cl. ..... 335/212; 335/210; 372/9

[58] Field of Search ..... 328/227, 228, 230; 372/2, 37, 9; 335/210, 212

[56] References Cited

U.S. PATENT DOCUMENTS

| | | | |
|---|---|---|---|
| 4,549,155 | 10/1985 | Halbach | 335/212 |
| 4,714,908 | 12/1987 | Watabe et al. | 335/212 |
| 4,727,551 | 2/1988 | Scharlemann | 372/2 |
| 4,731,598 | 3/1988 | Clarke | 335/210 |
| 4,876,687 | 10/1989 | Feinstein | 372/2 |
| 4,994,778 | 2/1991 | Leupold | 335/212 |
| 5,010,640 | 4/1991 | Gottschalk | 372/2 |
| 5,014,028 | 5/1991 | Leupold | 335/210 |
| 5,099,175 | 3/1992 | Schlueter et al. | 372/2 |

*Primary Examiner*—Sandra L. O'Shea
*Assistant Examiner*—Vip Patel
*Attorney, Agent, or Firm*—Wenderoth, Lind & Ponack

[57] ABSTRACT

A multipolar wiggler has magnets that are arranged in two opposed rows. A charged particle beam passes along the rows in the space defined between the two opposed rows. Alternating magnetic fields are produced along the direction of travel of the charged particle beam to cause the charged particle beam to follow a periodically undulating orbit. At least some of the magnets in each of the rows are offset from other magnets in the same row in a direction perpendicular to the direction of travel of the charged particles in a plane parallel to the opposed surfaces of the rows.

15 Claims, 4 Drawing Sheets

MULTIPOLAR WIGGLER

BACKGROUND OF THE INVENTION

The present invention relates to a multipolar wiggler for imparting periodic magnetic fields to electron beams to obtain laser beams or radiated beams with a cyclotron or a linear accelerator.

A multipolar wiggler is used to produce radiated beams by deflecting in a undulating pattern the orbit of charged particles, such as electrons, accumulated in a cyclotron or a linear accelerator. One example is disclosed in literature titled Nuclear Instruments and Methods in Physics Research 172 (1980) at pages 45–53. As shown in FIG. 5, this wiggler comprises a pair of rows of permanent magnets 1–4 and 1'–4'. The magnets are arranged so that the magnetized directions (shown by arrows) are arranged periodically. The corresponding upper and lower magnets are arranged so that different poles face each other. Thus, periodic magnetic fields are produced around the electron beam.

As is apparent from FIG. 5, the magnets 1–4 and 1'–4' of a conventional multipolar wiggler each have a rectangular shape elongate in a direction X and are arranged periodically as described above, with the electron beam orbit 5 extending in a direction Z between the upper and lower rows. The magnetic field produced around the electron beam orbit 5 is thus constant near the center of the electron beam orbit 5 with respect to the direction X (FIG. 6). Thus, there is some possibility that the electron beam may be deflected out of the multipolar wiggler depending on the state of the electron beam when entering the multipolar wiggler.

This problem is discussed in detail in Nuclear Instruments and Methods in Physics Research A304 (1991) on pages 753–758. This literature further states that this problem may be solved by applying a focusing force in the direction X to the electrons in the multipolar wiggler, and as a specific means for solving this problem, proposes multipolar wigglers as shown in FIGS. *7a* to *7d*. The wiggler shown in FIG. *7a* has the upper and lower magnets curved over the entire width thereof. The magnets of the wiggler in FIG. 7b are curved only at their central parts with respect to the widthwise direction. The wiggler of FIG. *7c* comprises trapezoidal magnets and the wiggler of FIG. *7d* uses trapezoidal and diamond-shaped magnets in combination.

The multipolar wigglers shown in FIGS. *7(a)–7(d)* are all structurally complicated compared with the wiggler shown in FIG. 5 and the manufacture of the magnets is difficult. Moreover, in any of the wigglers, the focusing force imparted to the electron beam is constant, so that it is difficult to adjust the focusing force after the wiggler has been completed even if the focusing force is too strong.

SUMMARY OF THE INVENTION

It is therefore a first object of the present invention to provide a multipolar wiggler which has a simple structure, which is easy to manufacture and which can impart a suitable focusing force to the electron beam.

A second object of the present invention is to provide a wiggler in which the focusing force is adjustable.

In accordance with the present invention, there is provided a multipolar wiggler in which magnets are arranged in an opposed pair of rows, in which charged particle beams pass alongside the rows in the space defined between the two opposed rows, and in which alternating magnetic fields are produced along the direction of travel of the charged particle beams to cause the charged particle beams to follow a periodically undulating orbit, characterized in that at least some of the magnets in each of the rows are offset from other magnets in the same row in a direction perpendicular to the direction of travel of the charged particle beams in a plane parallel to the opposed surfaces of the rows.

Also, according to the present invention, each of the predetermined magnets is provided with an adjusting device for moving the magnet in the magnet rows in a plane parallel to the opposed surfaces of the magnets and in a direction perpendicular to the direction of travel of the charged particles.

According to the present invention, a magnetic field can be produced around the electron beam axis so that its distribution curve is inclined in the direction perpendicular to the direction of travel of the electron beam. Thus, the electron beam entering the multipolar wiggler is prevented from scattering and getting out of the wiggler.

The wiggler according to the present invention has structure that is simpler than that of any other multipolar wiggler capable of providing a focusing force. Its accuracy can be improved easily. Adjustment of the focusing force is also easy.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
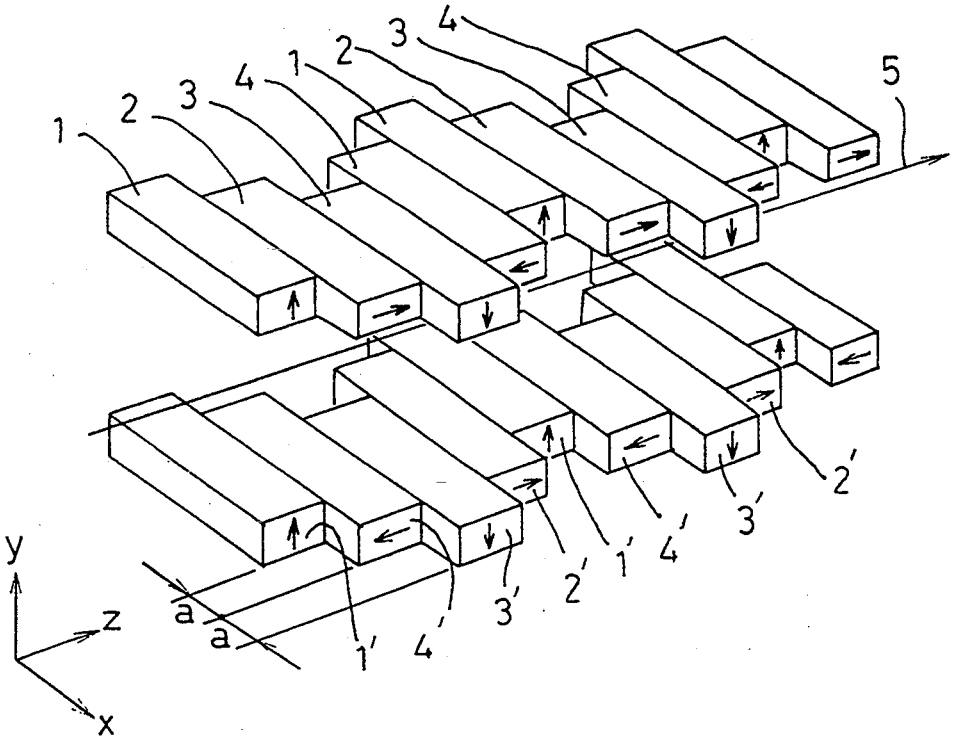
FIG. 1 is a schematic perspective view of one embodiment of a multipolar wiggler according to the present invention.

In FIG. 1, numerals 1–4 and 1'–4' indicate permanent magnets. Magnets 1 and 1' are magnetized vertically upwards, 2 and 2' are magnetized in the direction of travel of electrons, 3 and 3' are magnetized vertically downwards and 4 and 4' are magnetized in a direction opposite to the direction of travel of electrons. Four magnets constitute one magnet set. The upper magnet row comprising a plurality of sets of permanent magnets 1–4 extends parallel to the lower magnet row comprising a plurality of sets of permanent magnets 1'–4' with the electron beam orbit 5 extending therebetween Magnets 1 and 1', 2 and 4', 3 and 3' and 4 and 2' are arranged one over the other, respectively.

Of the permanent magnets, the permanent magnets 2 and 4 and 2' and 4' are, as viewed from the top, arranged uniformly with respect to the electron beam orbit 5 in the direction X, whereas the permanent magnets 1 and 3 and magnets 1' and 3' are arranged unevenly with respect to the electron beam orbit 5 in the direction X, that is, they are offset by a distance a in opposite directions by means of an adjusting device described later. The electron beams pass through a beam duct also described below.

Figure 2:
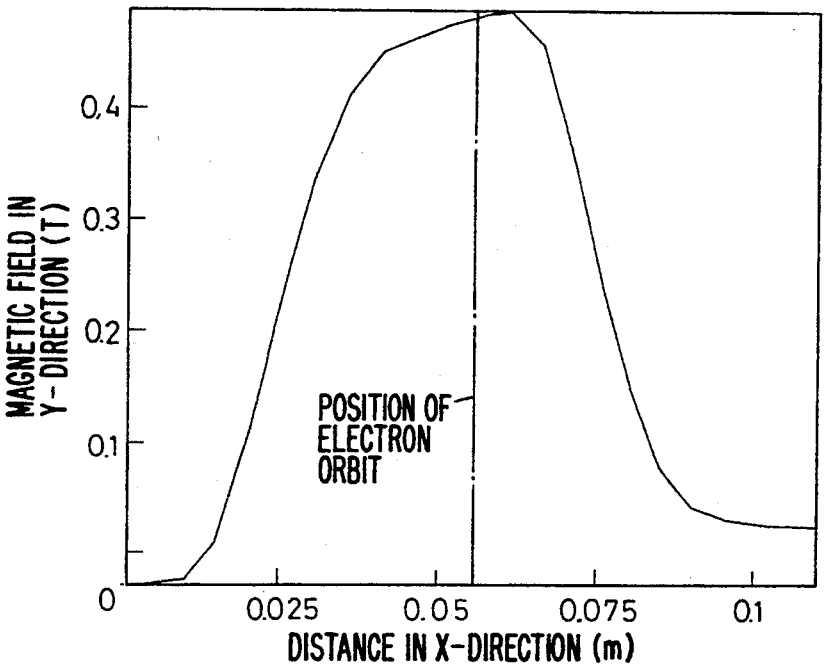
FIG. 2 is a graph showing the distribution of the Y-direction component of the magnetic force along the X direction, obtained by three-dimensional magnetic field analysis.

By arranging the permanent magnets 1 and 3 and 1' and 3' so as to be offset by a distance a in opposite directions with respect to the permanent magnets 2 and 4 and 2' and 4', the magnetic field produced between the magnet rows is unsymmetrical with respect to the X-axis direction. In other words, the Y-direction component of the magnetic field varies along the X-direction in FIG. 1. This state was analyzed three-dimensionally using the finite element method. The results are shown in FIG. 2. As is apparent from this figure, the Y-direction component of the magnetic field varies in the electron orbit position so that its distribution curve is inclined with respect to the X direction. It was confirmed that the rate of change of the Y-direction component in the magnetic field is adjustable by changing the distance a in FIG. 1.

Figure 3:
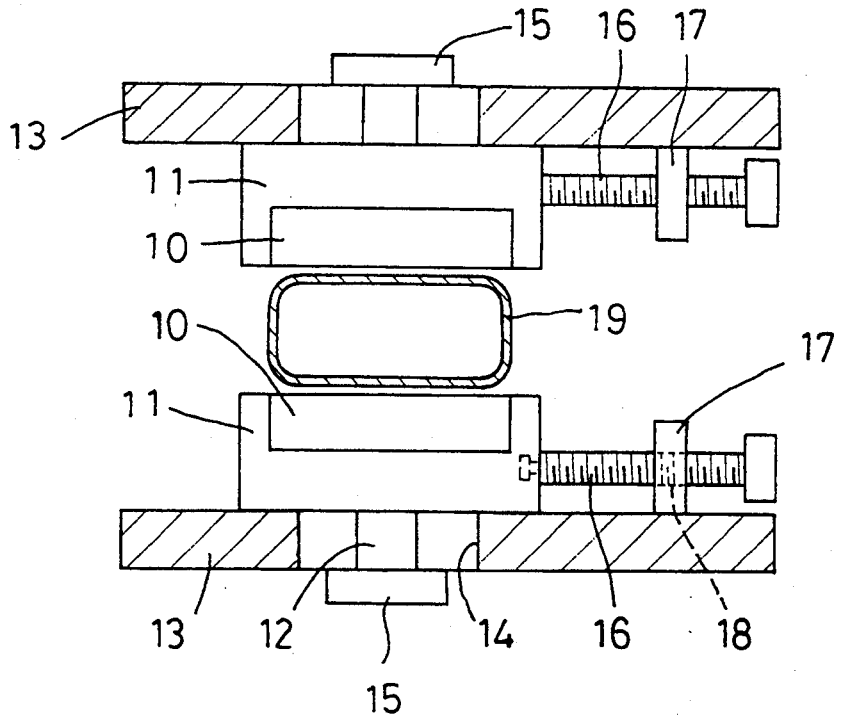
FIG. 3 is a cross-sectional view of part of the embodiment.
Figure 4:
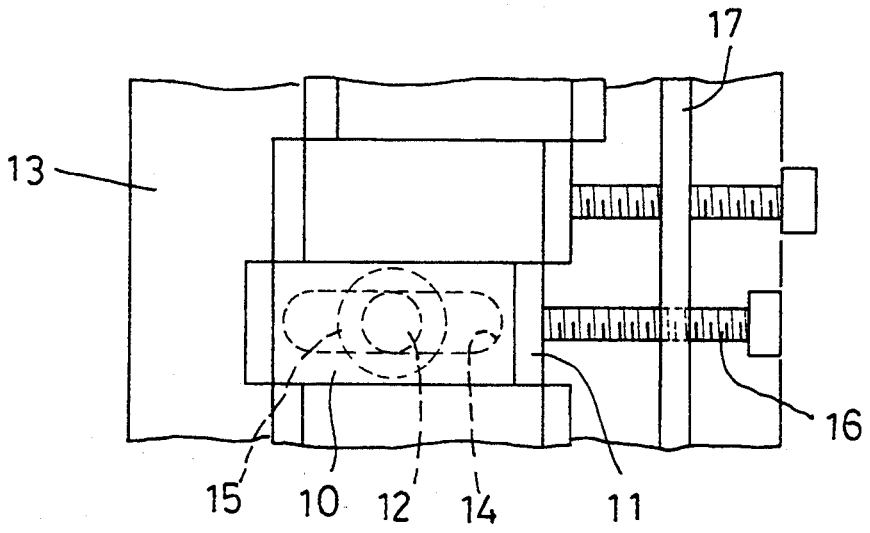
FIG. 4 is a plan view of the same.
Figure 5:
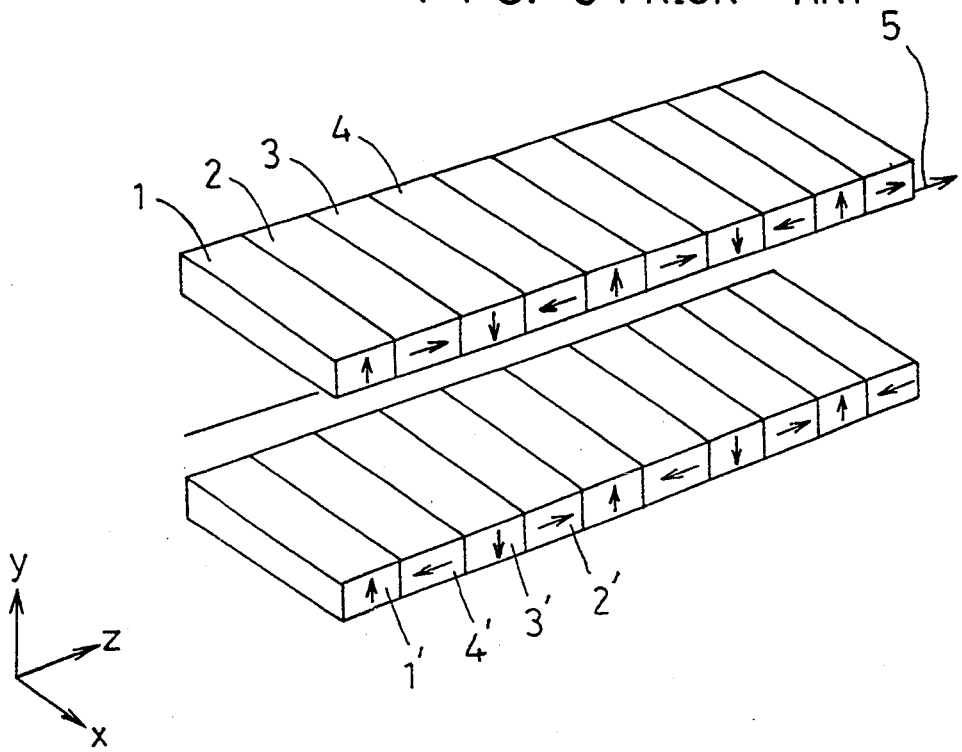
FIG. 5 PRIOR ART
FIG. 5 is a schematic perspective view of a conventional multipolar wiggler.
Figure 6:
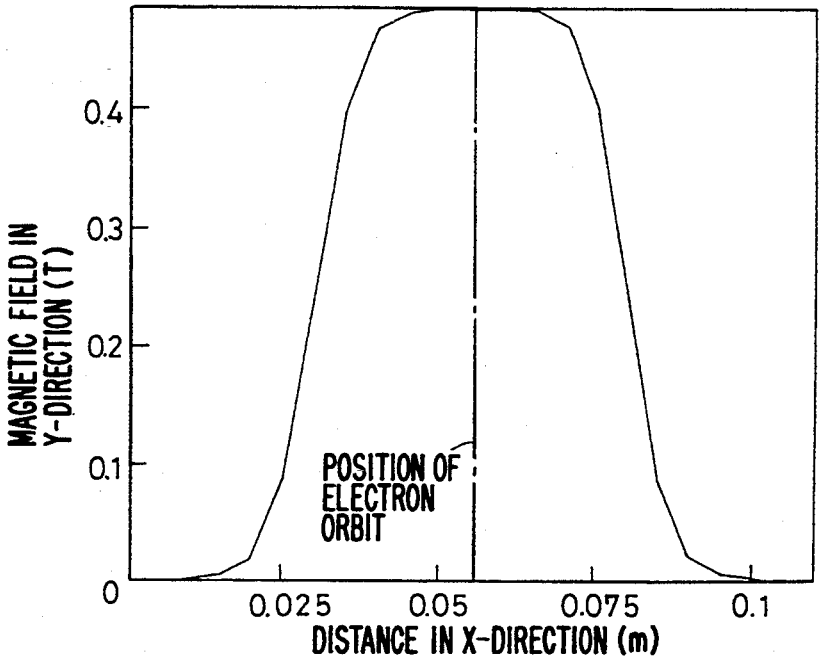
FIG. 6 is a graph showing the distribution of the Y-direction component of the magnetic field produced in the device shown in FIG. 5 along the X direction, obtained by three-dimensional magnetic field analysis; and FIGS. *7a–7d* are schematic perspective views of previously proposed multipolar wigglers.
Figure 7A:
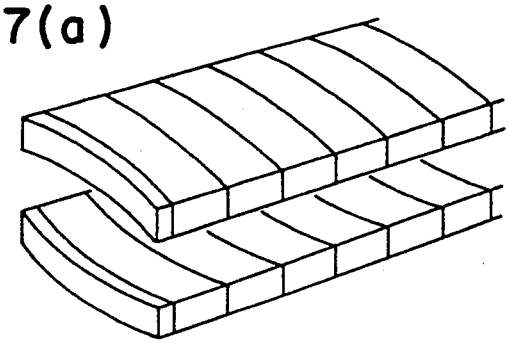
Figure 7B:
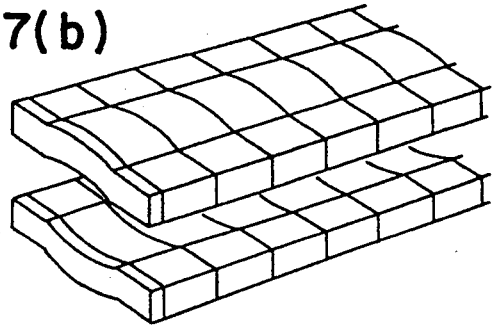
Figure 7C:
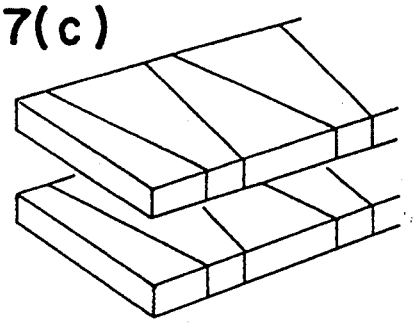
Figure 7D:
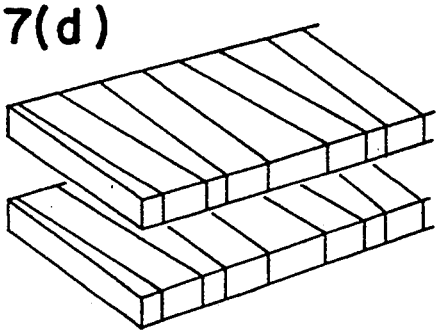

Referring next to FIGS. 3 and 4, the permanent magnets forming the upper and lower magnet rows 10, 10 are supported on a U-shaped holder 11 made of a non-magnetic material. A guide shaft 12 extends from the back of each holder 11. Bases 13 are provided one over the other and are each provided with a guide slot 14 elongate in the widthwise direction. The guide shafts 12 extend through the guide slots 14. Heads 15 are provided at one end of the shafts 12 to prevent the shafts from coming out of the slots 14. Adjacent ones of the holders 11 and the permanent magnets supported thereon are in contact with one another so as to be slidable freely in the direction of elongation of the guide slots 14. An adjusting screw 16 is rotatably mounted to one end of each holder 11 and is threadedly supported in a threaded hole 18 in a bearing member 17 secured to the base 13. In the figure, numeral 19 indicates the aforementioned beam duct.

By turning the respective adjusting screws 16, the holders 11 and the permanent magnets supported thereon can be moved in the widthwise direction and fixed in predetermined positions to change the distribution of magnetic field along the X-axis direction. The magnet positions may be adjusted so that the distance a will be zero.

Such adjusting devices may be provided only for the permanent magnets 1 and 3 and 1' and 3'.

Because the distribution of the magnetic field varies in the direction X, electrons that are farther away from the center have to pass through a stronger magnetic field than electrons that pass at the center. Such a strong magnetic field acts to reduce the deflection diameter of the electrons and thus to move the electrons toward the center. Electrons are thus prevented from scattering in the direction X in the multipolar wiggler, so that they are converged to the central part of the multipolar wiggler.

What is claimed is:

1. A multipolar wiggler comprising: opposed rows of magnets defining a space therebetween in which charged particle beams pass in a direction of travel, said magnets being oriented to produce alternating magnetic fields in the direction of travel of the charged particle beams to cause the charged particle beams to follow a periodically undulating orbit, and some of the magnets in each of the respective rows being offset from others of the magnets in the same row in a direction perpendicular to the direction of travel of the charge particle beams in a plane parallel to opposing surfaces of said rows of magnets.

2. A multipolar wiggler as claimed in claim 1, wherein all of said magnets have rectangular shapes.

3. A multipolar wiggler as claimed in claim 2, wherein said magnets are permanent magnets.

4. A multipolar wiggler as claimed in claim 1, wherein said magnets are permanent magnets.

5. A multipolar wiggler comprising: opposed rows of magnets defining a space therebetween in which charged particle beams pass in a direction of travel, said magnets being oriented to produce alternating magnetic fields along the direction of travel of the charged particle beams to cause the charged particle beams to follow a periodically undulating orbit; and adjusting means for moving at least some of the magnets in a direction perpendicular to the direction of travel of the charged particle beams in a plane parallel to opposing surfaces of said rows of permanent magnets.

6. A multipolar wiggler as claimed in claim 5, wherein said adjusting means is for moving all of the magnets in said direction perpendicular to the direction of travel.

7. A multipolar wiggler as claimed in claim 5, wherein all of said magnets having rectangular shapes, and the magnets in each of said rows are disposed side by side.

8. A multipolar wiggler as claimed in claim 7, wherein said magnets are permanent magnets.

9. A multipolar wiggler as claimed in claim 5, wherein said magnets are permanent magnets.

10. A multipolar wiggler comprising: opposed rows of magnets defining a space therebetween in which charged particle beams pass in a direction of travel, said magnets being oriented to produce alternating magnetic fields along the direction of travel of the charged particle beams to cause the charged particle beams to follow a periodically undulating orbit; a base member on which said rows of magnets are supported, at least some of said magnets in each of the rows thereof being supported so as to be slidable relative to said base member; a guide connected to each of said at least some of said magnets, said guide constraining said at least some of said magnets to slide in a direction perpendicular to the direction of travel of the charged particle beams in a plane parallel to opposing surfaces of said rows of magnets; and fixing means for fixing each of said at least some of said magnets in position relative to said base.

11. A multipolar wiggler as claimed in claim 10, wherein said guide comprises a plurality of slots in said base, each of said slots being elongate in said direction perpendicular to the direction of travel of the charged particle beams.

12. A multipolar wiggler as claimed in claim 10, wherein said fixing means comprises respective threaded rods coupled to said at least some of said magnets.

13. A multipolar wiggler as claimed in claim 10, wherein all of said magnets having rectangular shapes, and the magnets in each of said rows are disposed side by side.

14. A multipolar wiggler as claimed in claim 11, wherein said magnets are permanent magnets.

15. A multipolar wiggler as claimed in claim 10, wherein said magnets are permanent magnets.

* * * * *